United States Patent [19]

Sadeh et al.

[11] Patent Number: 4,784,071

[45] Date of Patent: Nov. 15, 1988

[54] AUTOMATIC SEWING MACHINE WITH SCANNING CAMERA SYSTEM

[76] Inventors: Yaacov Sadeh, 11/6 Bialik St., Nes Ziona; Yaakov Makover, Moshav Beit Elazari; Bar C. Mardix, HaRechasim St., Ramat-Gan, all of Israel

[21] Appl. No.: 38,773

[22] Filed: Apr. 15, 1987

[30] Foreign Application Priority Data

Dec. 25, 1986 [IL] Israel ..... 81091

[51] Int. Cl.[4] ..... D05B 21/00

[52] U.S. Cl. ..... 112/121.12

[58] Field of Search ..... 112/121.12, 121.15, 112/308, 309, 102, 103, 2, 153, 262.3; 364/400, 470

[56] References Cited

U.S. PATENT DOCUMENTS 4,498,404 2/1985 Sadeh ..... 112/121.12

4,526,116 7/1985 Mannel ..... 112/121.12 X 4,591,139 5/1986 Engelbart ..... 112/121.12 X

*Primary Examiner*—Peter Nerbun

*Attorney, Agent, or Firm*—Silverman, Cass, Singer & Winburn, Ltd.

[57] ABSTRACT

Computerized sewing apparatus having incorporated therein edge position sensing apparatus and the capability to modify, in real time, a pre-programmed sewing path in accordance with the actual position of the piece being sewn. The apparatus comprises a sewing head, a workholder, a microprocessor coupled to the workholder for moving the workholder relative to the sewing head, apparatus for sensing the edge position of an object on the workholder and arranged to provide an output signal corresponding thereto to the microprocessor, comparator apparatus in the microprocessor to compare the actual edge position with the programmed expected edge position and to determine any deviation, and apparatus coupled to the microprocessor for modifying the sewing path during sewing to compensate for any such deviation.

11 Claims, 3 Drawing Sheets

AUTOMATIC SEWING MACHINE WITH SCANNING CAMERA SYSTEM

FIELD OF THE INVENTION

The present invention relates to automatic sewing apparatus and, particularly, to computerized sewing apparatus which is gaining widespread use in both the footwear and garment industries.

BACKGROUND OF THE INVENTION

Computerized sewing apparatus was introduced more than a decade ago. Conventional systems perform sewing operations along a predetermined path using a sewing program. The main drawback of such systems lies in the fact that these systems are blind, i.e., they cannot see the work piece which is being sewn. This blindness is a severe handicap for present generation sewing systems. Leather and textiles are flexible materials which can change their size and position before and during the sewing operation. Hence, occasionally, the predetermined sewing path does not match the actual piece being sewn, and the pieces must be disqualified and rejected by quality inspectors.

A further drawback rests in the fact that, in an attempt to maintain accurate positioning of the pieces to be sewn relative to the sewing head, the sewn pieces are firmly held in a complicated workholder. This workholder aims to avoid, with limited success, the potential inaccuracy of pieces placement. Furthermore, the placement of the pieces in this workholder is complicated and, therefore, today is done manually by a trained operator.

SUMMARY OF THE INVENTION

It is an object of the present invention to provide sewing apparatus with incorporated visual edge position sensing and the capability to modify the sewing path during sewing in accordance with the actual position of the sewn piece.

There is thus provided in accordance with the present invention sewing apparatus including a mainframe, a sewing head mounted thereon, and a two dimensional manipulator which moves the workpiece relative to the sewing head in a horizontal plane. A scanning camera is mounted on a rotating bearing which is attached to the sewing head in such a way that the camera rotates concentric to the needle axis, scanning lines tangential to an imaginary circle around the needle's piercing point in the sewing plane.

Four illuminating lamps are attached to the rotating camera. The camera rotates around the needle using a motor and an encoder which positions the camera relative to the sewing direction in a way that the scanning always cuts the sewing pattern perpendicularly a few millimeters ahead of the sewing point. A special processor analyzes the signal generated by the line scanner and indicates the position, on the scanner, of the edge of the sewn piece. The position data calculated by the processor is transferred to the sewing system processor and is used to modify the sewing path in real time according to the actual piece's position.

The piece to be sewn is mounted on a simple flat workholder. The pieces are pinned and/or glued to the flat workholder. This mode of attachment enables the automatic loading and unloading of the sewn pieces to and from the workholder.

BRIEF DESCRIPTION OF THE DRAWINGS

Further features and advantages of the invention will be apparent from the description below. The invention is herein described, by way of example only, with reference to the accompanying drawings wherein.

DESCRIPTION OF A PREFERRED EMBODIMENT OF THE INVENTION

The present invention relates to computerized sewing apparatus having incorporated therein edge position sensing means and the capability to modify, in real time, a preprogrammed sewing path in accordance with the actual position of the piece being sewn. The apparatus comprises a sewing head, a workholder, a microprocessor coupled to the workholder for moving the workholder relative to the sewing head, means for sensing the edge position of an object on the workholder and arranged to provide an output signal corresponding thereto to the microprocessor, comparator means in the microprocessor to compare the actual edge position with the programmed expected edge position and to determine any deviation, and means coupled to the microprocessor for modifying the sewing path during sewing to compensate for any such deviation.

Figure 1:
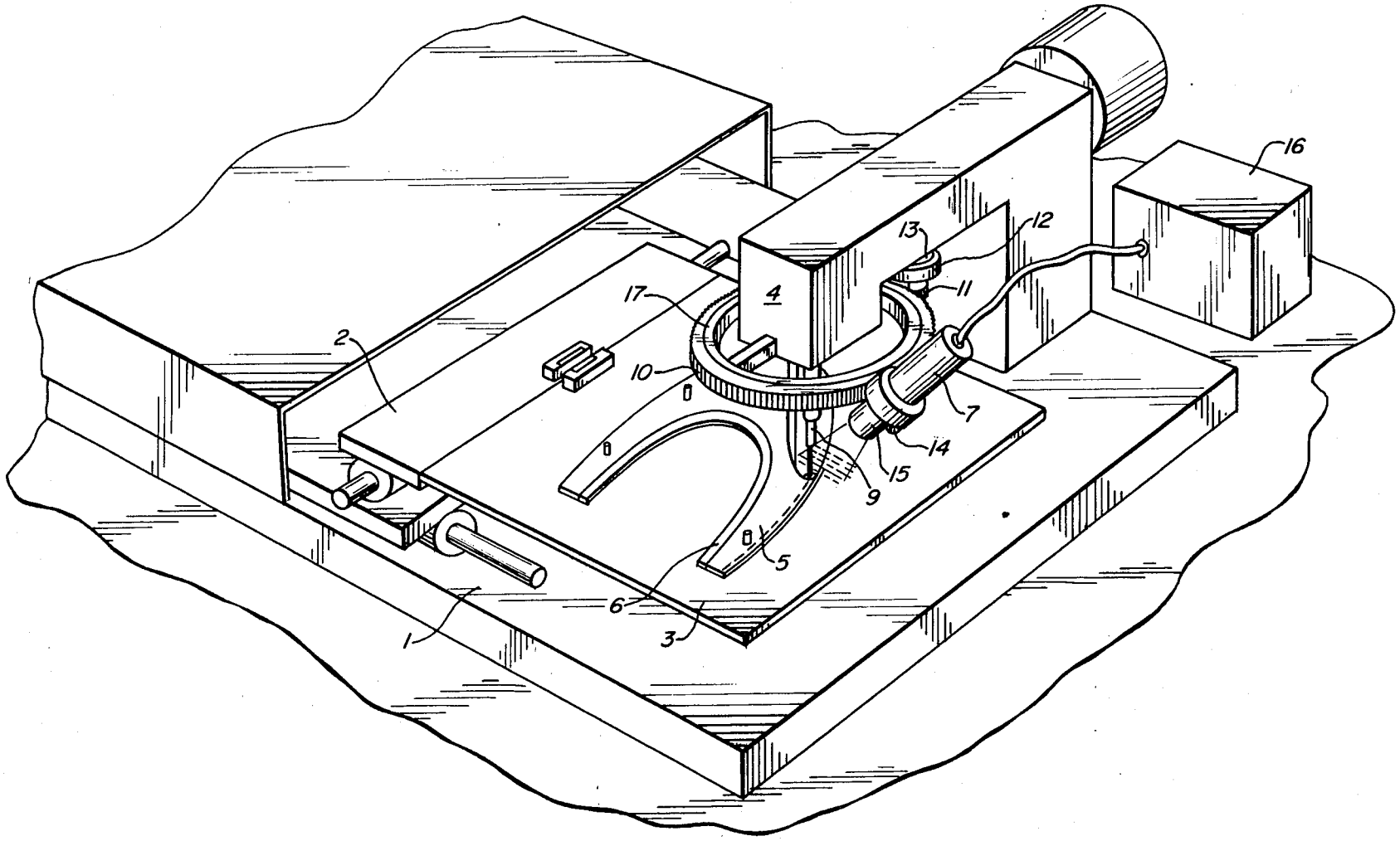
FIG. 1 is a perspective view illustrating one form of computerized sewing apparatus constructed and operative in accordance with the present invention.
Figure 3:
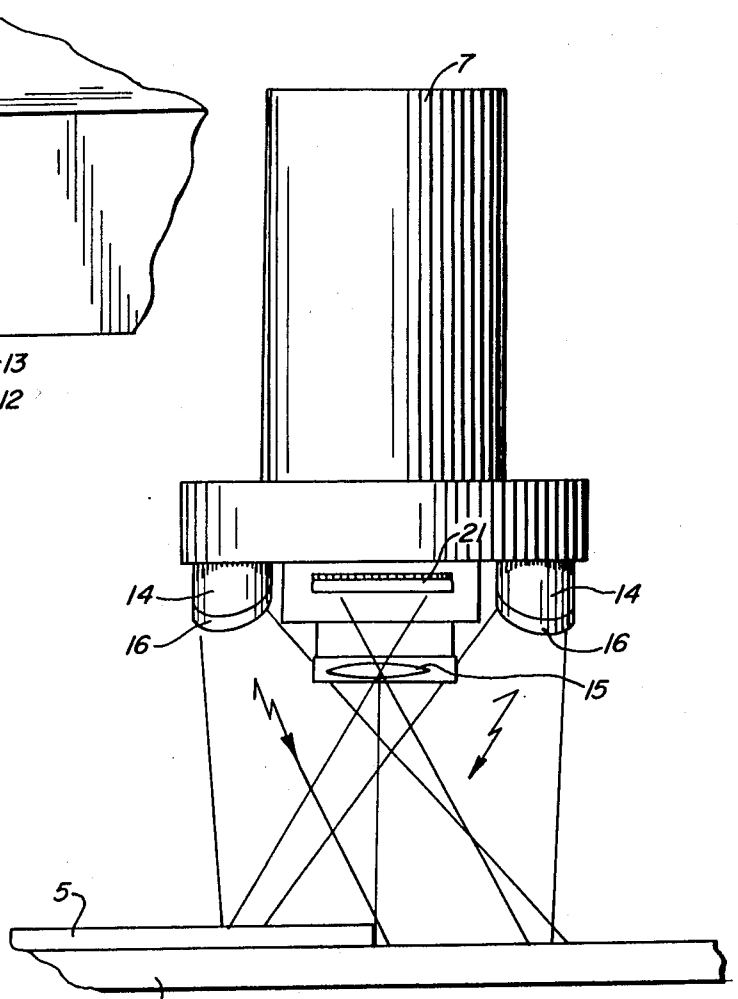
FIG. 3 illustrates the camera and illumination principle of the sewing apparatus of FIG. 1.
Figure 2:
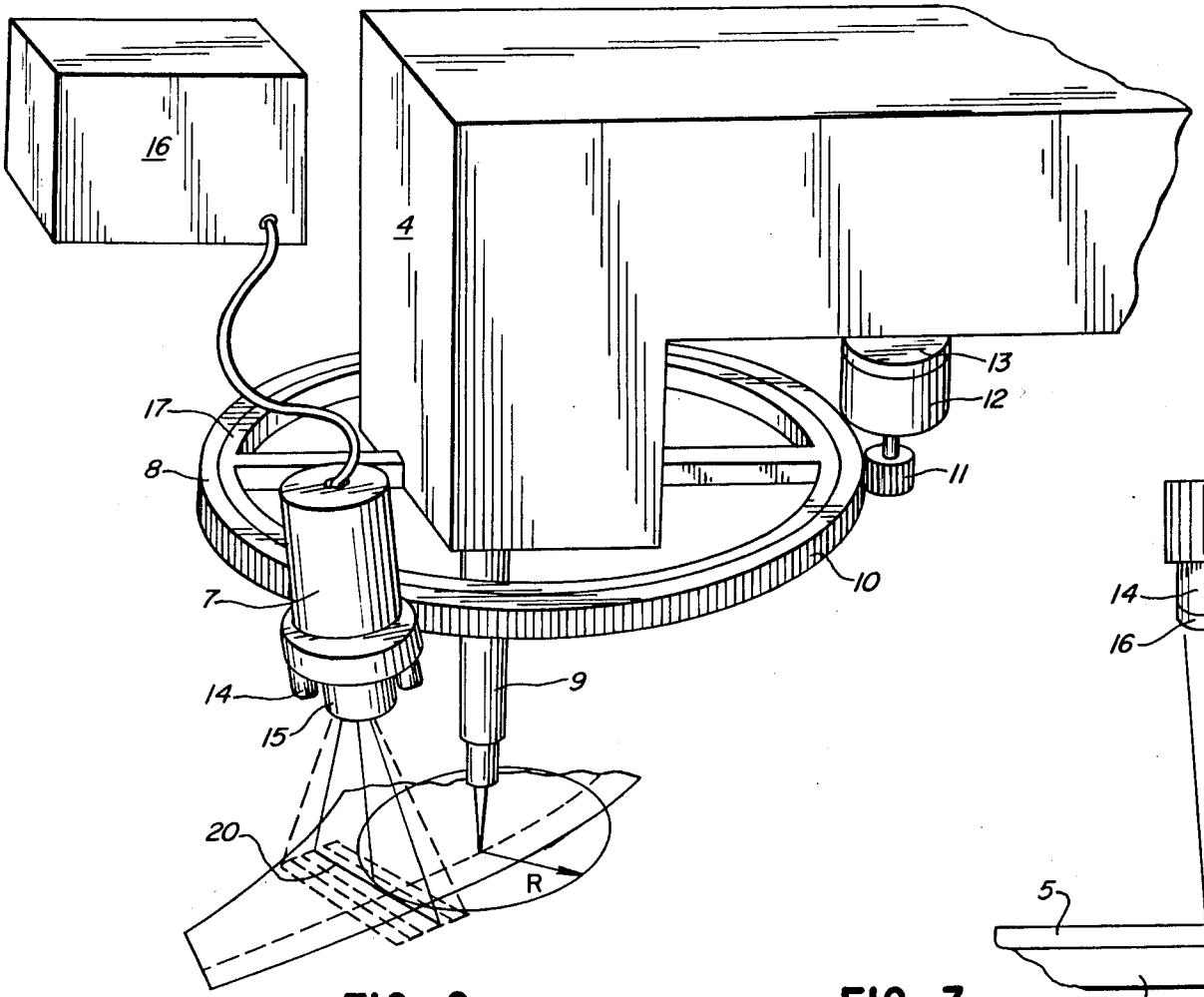
FIG. 2 is an enlarged detailed view of the optical edge sensor and its attachment relative to the sewing head.
Figure 4:
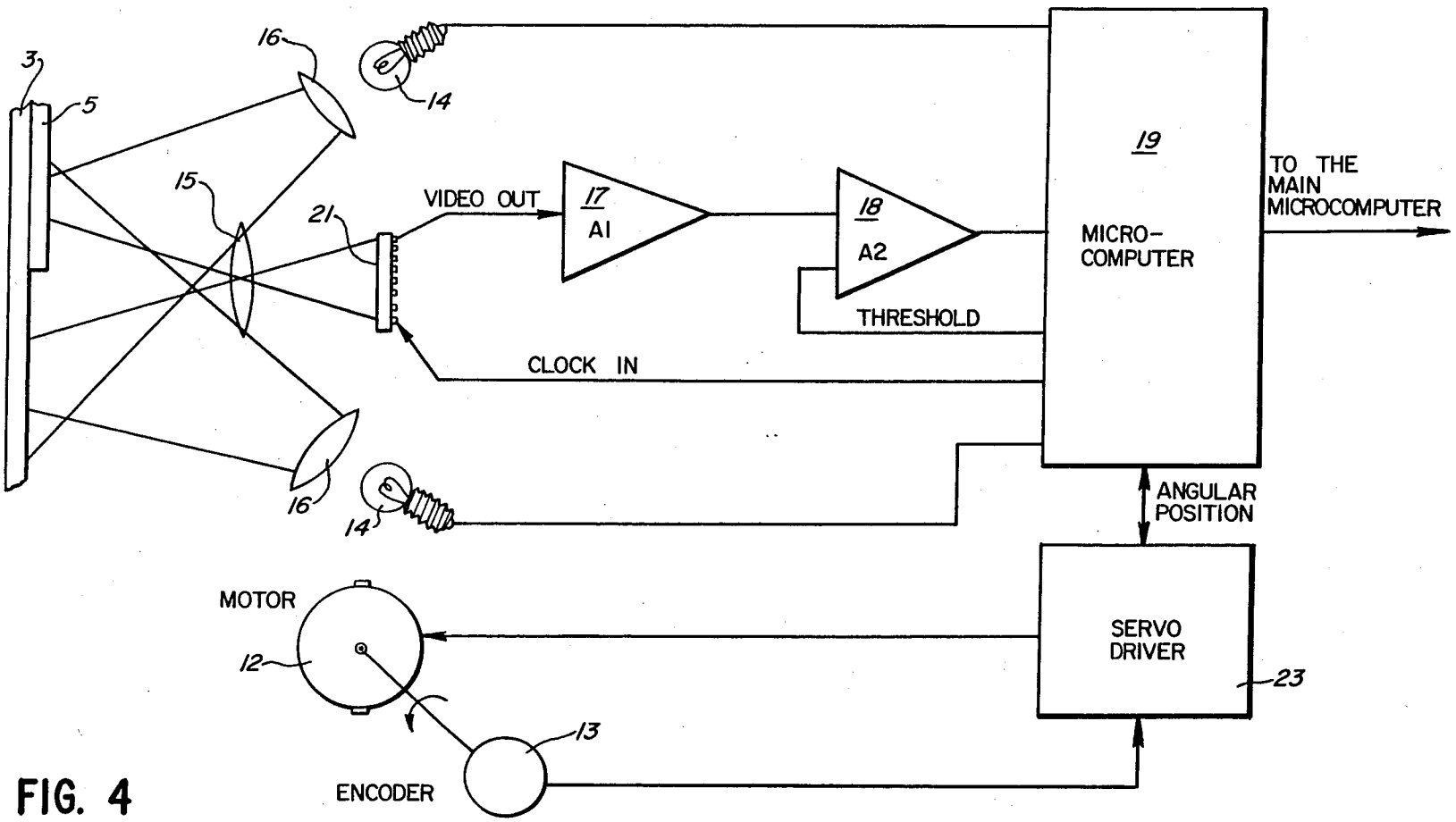
FIG. 4 is a block diagram of the edge sensing hardware and servo driver used to analyze and process the signal from the scanner and to transfer the information to the main processor.

One preferred embodiment of the invention will be described hereinbelow with reference to FIGS. 1 to 5. It will be appreciated, however, that a variety of alternate embodiments embodying this principle may also be utilized.

The sewing apparatus illustrated in FIGS. 1 to 4 comprises a mainframe 1 on which is mounted a sewing head 4. Sewing head 4 may comprise any conventional sewing head which is adapted to be driven by computerized commands, and includes a sewing needle affixed thereto via the needle bar 9.

A workholder 3 is coupled to the mainframe by a two-dimensional manipulator 2 for translating the workholder relative to the sewing head in any direction in the horizontal (X-Y) plane. Workholder 3 comprises a flat surface onto which the pieces 5 to be sewn are glued and/or taped with double sided adhesive coated tape 6, or retained thereon by any other known means. Manipulator 2 comprises any known X-Y table mechanism which is adapted to be driven by computerized commands.

A scanning camera 7 is coupled for rotation about the sewing head 4 with the needle bar 9 as its axis of rotation. In the illustrated embodiment, a fixed circular bearing 17 is affixed to the sewing head, concentric with needle bar 9. Coupled to fixed bearing 17 is an external rotary bearing 8 on which scanning camera 7 is mounted. A circular gear train 10 encircles external rotary ring 8 and is coupled to a small gear or pinion 11 which transfers to it the rotary motion. Gear 11 is mounted on the axis of a servo motor 12 which also rotates a coaxial shaft encoder 13. Encoder 13 may comprise any conventional incremental encoder of suitable size, such as, for example, a series RI incremental encoder of Sopelem, Levallois-Perret, France. Thus, the angular position of the camera is controlled by rotating the external ring of the bearing to which it is attached, its position being measured by the encoder. Alternately, any other mounting means permitting computer-controlled rotation about the needle bar axis may be utilized.

Servo motor 12 which rotates the camera is driven by a servo driver 23. Servo driver 23, in turn, is controlled by a microprocessor 19 which is programmed to rotate the camera in accordance with the sewing pattern so that the direction of scanning is always perpendicular to the direction of sewing, a few millimeters ahead of the sewing point. This servo system may comprise any conventional closed-loop position control system, such as that marketed by E G & G Torque Systems, Massachusetts, U.S.A.

At least two lamps 14 are mounted on the camera along the axis of the scanning lines. Preferably, four lamps 14 are provided, one on each side of the scanning area. Each lamp 14 includes a collimating lens 16 to project a narrow beam of light on the sewn piece. Lamps 14 are controlled by microprocessor 19 such that light from one lamp at a time is projected on the sewn piece 5 in a direction that causes the edge of the sewn piece to cast a shadow on the workholder 3. It will be appreciated that the illumination is programmed into microprocessor 19 together with the sewing pattern.

According to one preferred embodiment, scanning camera 7 comprises a line scanner including an imaging lens 15 which projects a one dimensional image onto a line scanning detector 21 inside the camera body. Detector 21 may comprise a charge coupled device (CCD), such as the CCD 143 of Fairchild Corp, U.S.A., a current injection device (CID) or any other equivalent line detector. An example of a suitable camera is the MICAM CCD micro-camera marketed by MLRN Electronics Ltd., Tel Aviv, Israel. Camera 7 is arranged to scan an imaginary line 20 on the piece 5 being sewn which is mounted on workholder 3. Line 20 is tangential to an imaginary circle around the needle's piercing point in the sewing plane.

According to an alternate embodiment, scanning camera 7 comprises an area scanning camera, such as a vidicon camera or a two-dimensional CCD, instead of a line scanner. An area scanning camera is arranged to scan a plurality of imaginary lines 20 (shown in broken lines), each of which is tangential to an imaginary circle around the needle's piercing point in the sewing plane.

Operation of the sewing apparatus of the present invention is as follows. A main microprocessor (not shown) directs workholder 3 to move the sewn piece 5 in the required directions in order to generate the sewing pattern along the edge of the piece. The main microprocessor also controls microprocessor 19. It will be appreciated that a single microprocessor may be utilized to combine both functions. However, this is less practical.

As described above, lamps 14 provide diagonal illumination of the sewn piece 5 so that its edge casts a shadow on workholder 3. Camera 7 is rotated in accordance with the sewing pattern so that the line of scanning is perpendicular to the direction of sewing, a few millimeters ahead of the sewing point. The contrast generated by the shadow enables the easy observation of the edge position on the image generated on the scanner.

The edge position is determined by transferring the video signal generated by CCD scanner 21 into a video amplifier 17. The amplification of this amplifier is controlled by the microprocessor 19 in a way that ensures a video signal well within the dynamic range of the amplifier. The pixel of the CCD scanner on which the shadow of the edge is imaged generates a low output voltage. A comparator 18 compares the output signal from amplifier 17 with a threshold level generated by the microprocessor 19, and outputs a triggering voltage whenever the video voltage from amplifier 17 falls below the threshold. This triggering voltage freezes the count of the pixel rate clock in a counter inside the microprocessor 19, as known per se. The data in this counter indicates the edge position of sewn piece 5 in pixel units.

Microprocessor 19 analyzes the signal generated by the scanner and indicates the position, on the scanner, of the edge of the sewn piece. The position data calculated by microprocessor 19 is transferred to the sewing system main processor. This information, together with the camera's angular position relative to the sewing head and workholder location, enables the main microprocessor to calculate the actual position of the edge in the scanning point. The expected edge position is known by the main processor which then determines the adjustment required to correct the sewing pattern. The main processor then modifies the sewing path in real time according to the piece's actual position by causing X-H manipulator 2 to change the position of workholder 3.

It will be appreciated by those skilled in the art that the invention is not limited to what has been shown and described hereinabove by way of example. Rather, the invention is limited solely by the claims which follow.

We claim:

1. Computerized sewing apparatus comprising:

a sewing head mounted on a main frame;

a workholder coupled to the main frame and comprising a flat holder mounted on a two dimensional manipulator for movement in the horizontal plane;

a microprocessor drivingly coupled to said manipulator for causing the workholder to move relative to the sewing head;

means for sensing the edge position of an object on said workholder comprising:

an area scanning camera coupled to the sewing head and disposed for rotation concentric to a needle bar mounted in said sewing head and arranged for scanning a plurality of lines each tangential to an imaginary circle around the needle's piercing point in the sewing plane;

four illuminating lamps coupled to said camera and disposed for diagonal illumination of the edge of said object being scanned;

said camera comprising means for generating a first output signal corresponding to said plurality of scanned lines;

encoder means coupled to said camera for providing a second output signal corresponding to the position of said camera; and processor means for activating said lamps and for receiving said first and second output signals and converting them into a third output signal corresponding to the edge position of said object, and providing said third output signal to said microprocessor;

comparator means in said microprocessor to compare the actual edge position with the programmed expected edge position and to determine any deviation; and means coupled to said microprocessor for modifying the sewing path during sewing to compensate for any such deviation.

2. Computerized sewing apparatus comprising:

a sewing head mounted on a main frame;

a workholder coupled to the main frame;

a microprocessor coupled to said workholder for causing the workholder to move relative to the sewing head;

means for sensing the edge position of an object on said workholder and arranged to provide, to said microprocessor, an output signal corresponding to the sensed edge position;

a scanning camera coupled to the sewing head and disposed for rotation concentric to a needle bar mounted in said sewing head and arranged for scanning at least one line tangential to an imaginary circle around the needle's piercing point in the sewing plane;

said camera including means for generating a first output signal corresponding to said at least one scanned line;

encoder means coupled to said camera for providing a second output signal corresponding to the position of said camera;

processor means for receiving said first and second output signals and converting them into a third output signal corresponding to the edge position of said object, and providing said third output signal to said microprocessor;

comparator means in said microprocessor to compare the actual edge position with the programmed expected edge position and to determine any deviation; and means coupled to said microprocessor for modifying the sewing path during sewing to compensate for any such deviation.

3. Sewing apparatus according to claim 2 and wherein said means for sensing comprises a line scanning camera arranged to scan a single line tangential to an imaginary circle around the needle's piercing point in the sewing plane.

4. Sewing apparatus according to claim 2 and wherein said means for sensing comprises an area scanning camera arranged for scanning a plurality of lines tangential to an imaginary circle around the needle's piercing point in the sewing plane.

5. Sewing apparatus according to claim 2 and wherein said workholder comprises a flat holder mounted on a two dimensional manipulator for movement in the horizontal plane; said manipulator being activated by said microprocessor.

6. Sewing apparatus according to claim 5 and wherein said object is affixed to said holder by glue.

7. Sewing apparatus according to claim 5 and wherein said object is affixed to said holder by double-sided adhesive tape.

8. Sewing apparatus according to claim 2 and further comprising at least two illuminating lamps coupled to said camera and disposed for diagonal illumination of the edge of said object being scanned; said lamps being activated by said processor means.

9. Sewing apparatus according to claim 8 and wherein said at least two illuminating lamps comprise four illuminating lamps.

10. Sewing apparatus according to claim 2 and wherein said camera is coupled to said sewing head by means of:

a fixed circular bearing affixed to the sewing head, concentric with the needle bar;

an external rotary bearing coupled to the fixed bearing;

a circular gear train encircling said external rotary bearing to which said camera is coupled, said gear train being driven by a pinion;

a servo motor arranged to rotate said pinion; and a shaft encoder coaxial with said servo motor.

11. Sewing apparatus according to claim 4 and further comprising four illuminating lamps coupled to said camera and disposed for diagonal illumination of the edge of said object being scanned; said lamps being activated by said processor means.

* * * * *

UNITED STATES PATENT AND TRADEMARK OFFICE

CERTIFICATE OF CORRECTION

PATENT NO. : 4,784,071

DATED : November 15, 1988

INVENTOR(S) : Sadeh, et al

It is certified that error appears in the above-identified patent and that said Letters Patent is hereby corrected as shown below:

On the title page, the second inventor's name "Yaakov" should read --Yaacov--.

Signed and Sealed this

Seventh Day of February, 1989

*Attest:*

DONALD J. QUIGG

*Attesting Officer*

*Commissioner of Patents and Trademarks*